US008746870B2

(12) United States Patent
Furukawa et al.

(10) Patent No.: US 8,746,870 B2
(45) Date of Patent: Jun. 10, 2014

(54) MATTING AGENT COATING DEVICE AND INKJET RECORDING DEVICE

(75) Inventors: Koji Furukawa, Kanagawa (JP); Kiyoshi Irita, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 197 days.

(21) Appl. No.: 13/356,652

(22) Filed: Jan. 24, 2012

(65) Prior Publication Data

US 2012/0212551 A1 Aug. 23, 2012

(30) Foreign Application Priority Data

Feb. 21, 2011 (JP) ..... 2011-034933

(51) Int. Cl.
*B41J 2/01* (2006.01)

(52) U.S. Cl.
USPC ..... 347/101

(58) Field of Classification Search
CPC ..... B41J 2002/012
See application file for complete search history.

(56) References Cited

U.S. PATENT DOCUMENTS 5,012,289 A * 4/1991 Aldrich et al. ..... 399/260
5,615,830 A * 4/1997 Matsunaga et al. ..... 239/8
6,623,816 B1 * 9/2003 Tanikawa et al. ..... 428/32.12
2001/0022607 A1 * 9/2001 Takahashi et al. ..... 347/103
2009/0103944 A1 * 4/2009 Shintani et al. ..... 399/111
2009/0214272 A1 * 8/2009 Furuya ..... 399/286

FOREIGN PATENT DOCUMENTS

JP 08160735 A * 6/1996
JP 8-224978 A 9/1996
JP 2002-500974 A 1/2002

* cited by examiner

*Primary Examiner* — Matthew Luu
*Assistant Examiner* — Tracey McMillion
(74) *Attorney, Agent, or Firm* — SOLARIS Intellectual Property Group, PLLC

(57) ABSTRACT

In a matting agent coating device, a matting agent within a supplying section is supplied to a metering section. A supplied amount of matting agent at a surface of a metering roller is metered by a metering blade, and an excess amount is filtered at a slit portion. Matting agent is supplied to an application roller that is provided directly beneath. For example, a closed-cell sponge rubber is used as a material of the metering roller, and a size of closed cells is around 5 to 100 times an average particle diameter of the matting agent. The matting agent that has been supplied to a surface of the application roller is transferred and applied onto a recording medium. The matting agent is transferred from the application roller onto image portions of the recording medium due to tackiness of an ink film forming an image.

6 Claims, 3 Drawing Sheets

MATTING AGENT COATING DEVICE AND INKJET RECORDING DEVICE

CROSS-REFERENCE TO RELATED APPLICATION

This application claims priority under 35 USC 119 from Japanese Patent Application No. 2011-034933 filed on Feb. 21, 2011, the disclosure of which is incorporated by reference herein.

BACKGROUND OF THE INVENTION

1. Field of the Invention

The present invention relates to a matting agent coating device and an inkjet recording device.

2. Description of the Related Art

Conventionally, inkjet printers have had the problem that printed matter, for which processing is completed, are damaged due to a phenomenon known as blocking in which inks on stacked printed matter adhere (bond) to one another due to insufficient drying and insufficient fixing of the image portions. In high-mass-production inkjet printers in particular, because there is the tendency for the drying and fixing time to be short, it is easy for insufficient drying and insufficient fixing to occur, and further, it is easy for blocking to arise when carrying out printing on thick paper.

Such blocking may arise, in addition to inkjet printers, in offset printers as well for example. In offset printers, blocking is prevented by spraying, onto the sheet surfaces, a powder for preventing adhesion between sheets.

However, with a powder spraying method, the problem arises that the printer interior is dirtied due to diffusion of excess powder, and, when carrying out double-sided printing, due to powder that has been supplied to printed matter dropping-off at the time of printing the reverse surface. In particular, in an inkjet printer of a type that carries out printing by coating a pre-processing liquid onto the sheets, the powder spraying method may become problematic with respect to the points that the powder may become mixed into the pre-processing liquid coating section, or poor ejection may be caused due to the powder adhering to the inkjet heads.

Thus, an image recording device has been disclosed in which an air curtain is provided within a printer, powder is prevented from being diffused within the printer and to the device exterior, and trouble due to a reduction in the number of times cleaning is carried out, or wear of mechanical parts caused by powder, or the like, is suppressed (see, for example, Japanese Patent Application National Publication No. 2002-500974).

Or, there is a method in which a matting agent is affixed at predetermined intervals onto a sheet by an affixing roller having concave portions at the surface thereof, and diffusion of the matting agent within the printer is prevented, and the matting agent is prevented from dropping-off due to the matting agent being dispersed within a solvent that is adhesive. Further, there is a method in which a matting agent is prevented from dropping-off due to the matting agent being dispersed in a solvent that is not adhesive, and, after coating onto the printed matter, heating is carried out, and the solvent is thereby evaporated and the matting agent is fused and fixed (see, for example, Japanese Patent Application Laid-Open (JP-A) No. 8-224978).

However, although aforementioned Japanese Patent Application National Publication No. 2002-500974 discloses a measure for preventing diffusion of excess powder by an air curtain, there is the problem that dirtying of the printer by the powder that drops-off from printed matter cannot be overcome.

Further, if the structure disclosed in JP-A No. 8-224978 is applied to an inkjet printer in which it is easy for insufficient drying of a dispersion liquid, in which a matting agent is dispersed, and insufficient fixing to occur, there is the problem that there is the concern that blocking will occur more easily.

Thus, a method is desired that coats a matting agent that is a powder onto the surface of printed matter without using a dispersion liquid, and applies the matting agent to the printed matter without the matting agent falling-off from the surface.

SUMMARY OF THE INVENTION

In view of the above-described circumstances, an object of the present invention is to provide a matting agent coating device and an inkjet recording device that apply an appropriate amount of a matting agent that is a powder onto the surface of a medium by pressing by an application roller.

A matting agent coating device of a first aspect of the present invention has: a metering section that meters a matting agent that serves as a powder; and an application roller that applies the matting agent, that has been supplied to an outer peripheral surface of the application roller by the metering section, to a recording medium surface by pressing, wherein the metering section has a closed-cell rubber roller that holds the matting agent in minute holes of an outer peripheral surface of the closed-cell rubber roller, and a blade that squeezes a surface of the closed-cell rubber roller.

In accordance with the above-described structure, a matting agent that improves the stacker blocking performance is metered at the surface of the closed-cell rubber roller, and is applied to a recording medium surface by pressing by the application roller. Due thereto, dirtying of the device interior and the recording medium by the matting agent is prevented, and the matting agent can be applied onto the recording medium surface with stable metering accuracy.

In the matting agent coating device of the first aspect, the outer peripheral surface of the application roller may have smoothness Ra of less than or equal to 1 μm and surface energy of less than or equal to 80 mN/m.

In accordance with the above-described structure, by making the outer peripheral surface of the application roller have a smoothness Ra of less than or equal to 1 μm and surface energy of less than or equal to 80 mN/m, application of the matting agent onto the recording medium surface can be carried out stably.

In the matting agent coating device of the above-described structure, the application roller may include a rubber roller whose outer peripheral surface is covered by a PFA film.

In accordance with the above-described structure, due to the outer peripheral surface being covered by a PFA film, the application roller can be made to be highly stable while the surface smoothness and surface energy are maintained within desired ranges.

In the matting agent coating device of the first aspect, a pore size, that is a diameter of the minute holes of the outer peripheral surface of the closed-cell rubber roller, may be 5 to 100 times an average particle diameter of the matting agent.

In accordance with the above-described structure, poor filling of the matting agent due to the pore size being too small can be prevented, and dropping-out of the matting agent due to insufficient holding force caused by the pore size being too large can be prevented.

The matting agent coating device of the first aspect may further have a cleaning section that is formed from a cleaning blade that abuts the outer peripheral surface of the application roller and scrapes-off, from the outer peripheral surface of the application roller, matting agent that was not applied to the recording medium surface, and a suction section that sucks and removes matting agent scraped-off by the cleaning blade.

In accordance with the above-described structure, the matting agent, that has not been applied from the application roller onto the recording medium surface, is recovered and re-used, and, at the same time, dirtying of the device interior can be prevented.

An inkjet recording device of a second aspect of the present invention has the matting agent coating device of any of the above-described structures.

In accordance with the above-described invention, a matting agent that improves the stacker blocking performance is metered at the surface of the closed-cell rubber roller, and is applied to a recording medium surface by pressing by the application roller. Due thereto, dirtying of the device interior and the recording medium by the matting agent is prevented, and the matting agent can be applied onto the recording medium surface with stable metering accuracy.

Because the present invention is structured as described above, there are provided a matting agent coating device and an inkjet recording device that apply an appropriate amount of a powder matting agent to the surface of a medium by pressing by an application roller.

DETAILED DESCRIPTION OF THE INVENTION

Examples of exemplary embodiments relating to the present invention are described hereinafter with reference to the drawings.

Figure 1:
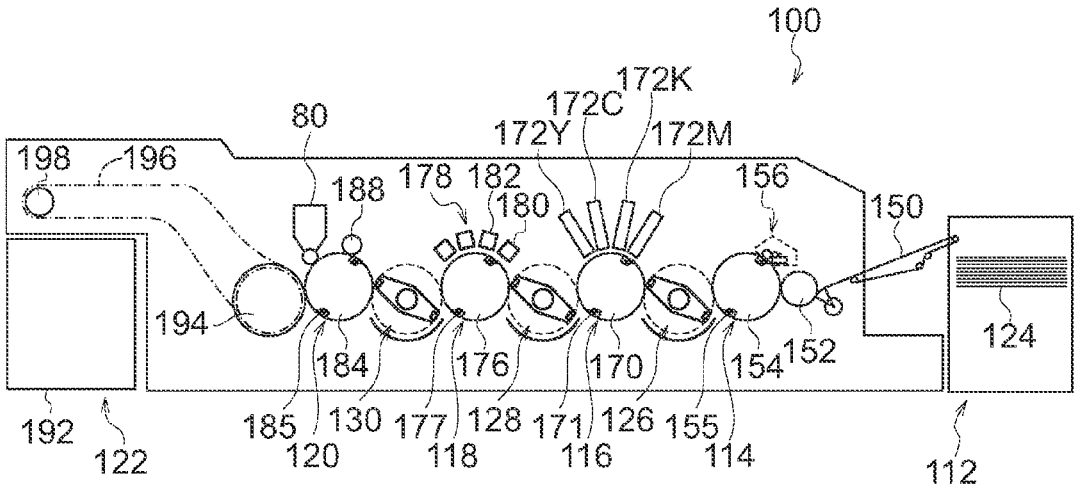
FIG. 1 is a schematic drawing showing an image recording device relating to an exemplary embodiment of the present invention.

FIG. 1 is a schematic structural drawing showing the overall structure of an inkjet recording device relating to an exemplary embodiment of the present invention.

An inkjet recording device 100 is an impression-cylinder direct-drawing inkjet recording device that forms a desired color image by ejecting aqueous inks, that contain thermoplastic resin and color materials, of plural colors from inkjet heads 172M, 172K, 172C, 172Y, onto the recording surface of a recording medium P that is held at an impression cylinder (an image drawing drum 170) of an image drawing section 116. The inkjet recording device 100 is an on-demand type image forming device to which is applied a two-liquid reaction (agglomeration) method that carries out image formation on the recording medium P by, before ejecting ink, applying a processing liquid (containing an agglomerating agent that causes components within the ink compositions to agglomerate) onto the recording medium P and causing the processing liquid and the liquid inks to react.

Namely, as shown in FIG. 1, the inkjet recording device 100 is mainly structured by a sheet feeding section 112, a processing liquid applying section 114, the image drawing section 116, a drying section 118, a fixing section 120, and a sheet discharging section 122.

The sheet feeding section 112 is a mechanism that feeds the recording medium P to the processing liquid applying section 114. The recording media P, that are cut sheets, are stacked in the sheet feeding section 112. A sheet feed tray 150 is provided at the sheet feeding section 112, and the recording media P are fed one-by-one from the sheet feed tray 150 to the processing liquid applying section 114. In order to prevent floating-up of the recording medium P, suction holes may be provided in the outer surface of the sheet feed tray 150, and a suction device that carries out suction from the suction holes may be connected thereto.

In the inkjet recording device 100 of the present exemplary embodiment, plural types of the recording media P that are different paper types or sizes (sheet sizes) can be used as the recording media P. An aspect is also possible in which plural sheet trays (not shown), in which various types of recording media are separately stacked respectively, is provided at the sheet feed section 112, and the sheet that is fed from these plural sheet trays to the sheet feed tray 150 is switched automatically. Further, an aspect is also possible in which an operator selects or replaces a sheet feed tray as needed. Note that, in the present example, cut sheets are used as the recording media P, but a structure is possible in which the recording medium P is cut to the needed size from a continuous sheet (rolled sheet) and is fed.

The processing liquid applying section 114 is a mechanism that applies processing liquid to the recording surface of the recording medium P. The processing liquid contains an agglomerating agent that agglomerates components within the ink compositions that are applied at the image drawing section 116. Due to the processing liquid and the ink contacting, an agglomerating reaction with the ink is caused, separation of the color material and the solvent of the ink is promoted, and formation of a high quality image is possible without bleeding or landing interference (uniting) or color mixing after landing of the ink arising. Note that the processing liquid can be structured by using other components as needed, in addition to the agglomerating agent. By using the processing liquid together with the ink composition, the inkjet recording can be made to be high speed, and, even with the high speed recording, an image having high density and high resolution and that is drawn excellently (e.g., in which the reproduction of fine lines and extremely detailed portions is excellent) is obtained.

As shown in FIG. 1, the processing liquid applying section 114 has a sheet feeding cylinder 152, a processing liquid drum 154, and a processing liquid coating device 156. The processing liquid drum 154 is a drum that holds the recording medium P and rotates and conveys the recording medium P. Claw-shaped holding means (grippers) 155 are provided at the outer peripheral surface of the processing liquid drum 154, and the leading end of the recording medium P can be held by the recording medium P being nipped-in between the claws of the holding means 155 and the peripheral surface of the processing liquid drum 154. Suction holes may be provided in the outer peripheral surface of the processing liquid drum 154, and a suction device for carrying out suction from the suction holes may be connected thereto. Due thereto, the recording medium P can be held tightly to the peripheral surface of the processing liquid drum 154.

The processing liquid coating device 156 is provided at the outer side of the processing liquid drum 154 so as to face the peripheral surface thereof. The processing liquid is coated onto the recording surface of the recording medium P by the processing liquid coating device 156.

The recording medium P, to which the processing liquid has been applied at the processing liquid applying section 114, is transferred from the processing liquid drum 154 via an intermediate conveying section 126 (first transfer cylinder conveying means) to the image drawing drum 170 of the image drawing section 116.

The image drawing section 116 has the image drawing drum 170 and the inkjet heads 172M, 172K, 172C, 172Y. Although not shown in FIG. 1, a sheet pressing roller, for removing wrinkles of the recording medium P, may be disposed at the side before the inkjet heads 172M, 172K, 172C, 172Y, with respect to the image drawing drum 170.

In the same way as the processing liquid drum 154, the image drawing drum 170 has claw-shaped holding means (grippers) 171 at the outer peripheral surface thereof, and holds and fixes the leading end portion of the recording medium. Further, the image drawing drum 170 has plural suction holes in the outer peripheral surface thereof, and the recording medium P is attracted to the outer peripheral surface of the image drawing drum 170 by negative pressure. Due thereto, contact of the recording medium P with the heads due to floating-up of the recording medium P is avoided, and paper jamming is prevented. Further, non-uniformity of the image due to fluctuations in clearance between the recording medium P and the heads is prevented.

The recording medium P that is fixed to the image drawing drum 170 in this way is conveyed with the recording surface thereof facing outward, and aqueous inks, that contain thermoplastic resin and color materials, are ejected onto this recording surface from the inkjet heads 172M, 172K, 172C, 172Y.

Each of the inkjet heads 172M, 172K, 172C, 172Y is a full-line-type inkjet recording head (inkjet head) having a length that corresponds to the maximum width of the image formation region at the recording medium P. Nozzle rows, at which plural nozzles for ejecting ink are arrayed, are formed at the ink ejecting surface of each of the inkjet heads 172M, 172K, 172C, 172Y, over the entire width of the image formation region. Each of the inkjet heads 172M, 172K, 172C, 172Y is set so as to extend in a direction orthogonal to the conveying direction of the recording medium P (the rotating direction of the image drawing drum 170).

Droplets of inks of corresponding colors are ejected from the respective inkjet heads 172M, 172K, 172C, 172Y toward the recording surface of the recording medium P that is held tightly on the image drawing drum 170. Due thereto, the inks contact the processing liquid, that was applied in advance to the recording surface at the processing liquid applying section 114, and the color materials (pigments) dispersed within the inks agglomerate, and agglomerates of the color materials are formed. Flowing of color materials on the recording medium P, and the like, are thereby prevented, and an image is formed on the recording surface of the recording medium P.

Note that, in the present example, the reference colors (four colors) of CMYK are given as an example, but the combination of the ink colors and the number of colors is not limited to that of the present exemplary embodiment, and light inks, dark inks, and inks of specific colors may be added as needed. For example, a structure to which is added an inkjet head that ejects a light ink such as light cyan, light magenta or the like, also is possible. Further, the order in which the heads of the respective colors are arranged also is not particularly limited.

Image drawing can be carried out in a single pass on the recording medium P by the image drawing section 116 that is structured as described above. Due thereto, high-speed recording and high-speed output are possible, and the mass produceability can be improved.

The recording medium P, on which an image is formed at the image drawing section 116, is transferred from the image drawing drum 170 via an intermediate conveying section 128 (second transfer cylinder conveying means) to a drying drum 176 of the drying section 118.

The drying section 118 is a mechanism that dries the moisture contained in the solvent that separated due to the color material agglomerating action. As shown in FIG. 1, the drying section 118 has the drying drum 176 and a solvent drying device 178. In the same way as the processing liquid drum 154, the drying drum 176 has claw-shaped holding means (grippers) 177 at the outer peripheral surface thereof, and holds the leading end of the recording medium P by the holding means 177. Further, the drying drum 176 has suction holes (not shown) in the drum outer peripheral surface, and the recording medium P can be attracted to the drying drum 176 by negative pressure. Moreover, air blowing means 180 (attraction assisting means) and the solvent drying device 178 are provided so as to face the outer peripheral surface of the drying drum 176.

The air blowing means 180 is for assisting the attraction of the recording medium P to the drying drum 176. The air blowing means 180 blows-out air obliquely toward the transverse direction end portion sides of the recording medium P, such that the recording medium P, whose distal end is held by the holding means 177, is reliably attracted from the leading end side toward the trailing end side thereof, without wrinkles arising therein.

The solvent drying device 178 is disposed at a position facing the outer peripheral surface of the drying drum 176, and is structured by hot air drying means 182 at which plural combinations of an IR heater or the like and a fan are disposed. Various drying conditions can be realized by appropriately adjusting the temperature and the air volume of the hot air that is blown-out toward the recording medium P from respective hot air blow-out nozzles of the hot air drying means 182. The recording medium P is conveyed while being attracted to and restrained at the outer peripheral surface of the drying drum 176 such that the recording surface thereof faces the outer side, and drying processing by the aforementioned IR heaters and warm air blow-out nozzles is carried out with respect to the recording surface.

Suction holes are provided in the outer peripheral surface of the drying drum 176, and the drying drum 176 has a suction device that carries out suction from these suction holes. The recording medium P can thereby be tightly held at the peripheral surface of the drying drum 176. Further, cockling of the recording medium P can be prevented because the recording medium P can be restrained at the drying drum 176 by carrying out negative pressure suction.

The recording medium P, on which drying processing has been carried out at the drying section 118, is transferred from the drying drum 176 via an intermediate conveying section 130 (third transfer cylinder conveying means) to a fixing drum 184 of the fixing section 120.

The fixing section 120 is structured by the fixing drum 184 and a pressing roller 188 (smoothing means). In the same way as the processing liquid drum 154, the fixing drum 184 has claw-shaped holding means (grippers) 185 at the outer peripheral surface thereof, and can hold the leading end of the recording medium P by the holding means 185.

Due the rotation of the fixing drum 184, the recording medium P is conveyed with the recording surface thereof facing outward, and smoothing processing and fixing by the pressing roller 188 are carried out on this recording surface.

Due to the pressing roller 188 applying pressure to the recording medium P on which the inks have dried, the pressing roller 188 carries out smoothing of the recording medium P and fixing of the inks.

Note that an in-line sensor that carries out inspection of the image formed on the recording medium P may be provided so as to face the outer peripheral surface of the fixing drum 184. The in-line sensor is a measuring means for measuring a check pattern and the moisture content, surface temperature, degree of gloss, and the like of the image fixed on the recording medium P, and, for example, a CCD line sensor can suitably be used therefor.

As described hereafter, a matting agent coating section 80 is provided in succession with the fixing section 120 at a position facing the outer peripheral surface of the fixing drum 184. The matting agent coating section 80 meters, by a metering roller 87B, a matting agent 200 that is stored in a main tank 82, and applies the matting agent 200 to the surface of the recording medium P by an application roller 88. Due thereto, the recording medium P, on whose surface the matting agent 200 is coated, is conveyed to the sheet discharging section 122, and blocking (bonding) of the recording media P at the time when a large number of the recording media P are in a stacked state within a sheet discharging unit 192 is prevented.

The sheet discharging section 122 is provided following these. The sheet discharging unit 192 is set at the sheet discharging section 122. A transfer cylinder 194 and a conveying chain 196 are provided from the fixing drum 184 of the fixing section 120 to the sheet discharging unit 192. The conveying chain 196 is trained around a tension roller 198. The recording medium P that has passed the fixing drum 184 is sent, via the transfer cylinder 194, to the conveying chain 196, and is transferred from the conveying chain 196 to the sheet discharging unit 192.

Although not shown in FIG. 1, the inkjet recording device 100 of the present example has, in addition to the above-described structures, ink storage/filling sections that supply inks to the respective inkjet heads 172M, 172K, 172C, 172Y, and means that supplies the processing liquid to the processing liquid applying section 114. The inkjet recording device 100 also has head maintenance sections that carry out cleaning (wiping of the nozzle surfaces, purging, suctioning of nozzles, and the like) of the respective inkjet heads 172M, 172K, 172C, 172Y, position detecting sensors that detect the position of the recording medium P on the sheet conveying path, temperature sensors that detect the temperatures of the respective sections of the device, and the like.

<Details of Respective Sections>

Figure 2:
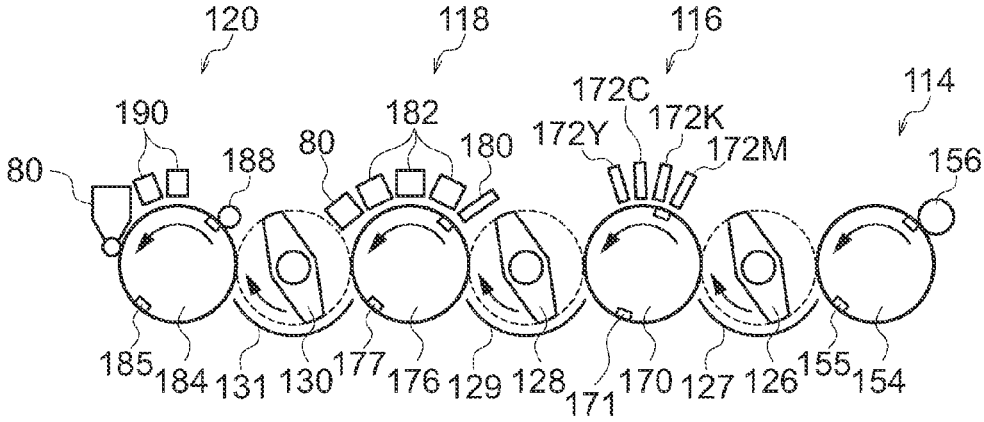
FIG. 2 is a schematic drawing showing main portions of the image recording device relating to the exemplary embodiment of the present invention.

The processing liquid applying section 114, the image drawing section 116, the drying section 118 and the fixing section 120, that are the main portions of the inkjet recording device 100 of the present exemplary embodiment, are shown in an enlarged manner in FIG. 2. The inkjet recording device relating to the present invention is described in further detail.

As shown in FIG. 2, the processing liquid drum 154, the intermediate conveying section 126 (first transfer cylinder conveying means), the image drawing drum 170, the intermediate conveying section 128 (second transfer cylinder conveying means), the drying drum 176, the intermediate conveying section 130 (third transfer cylinder conveying means), and the fixing drum 184 are disposed so as to be lined-up. The recording medium P is conveyed by these respective drums, and, while being conveyed, processing liquid application, image drawing, drying and fixing are carried out in that order thereon.

The respective intermediate conveying sections (the first transfer cylinder conveying means 126, the second transfer cylinder conveying means 128, the third transfer cylinder conveying means 130) have ribbed guiding members 127, 129, 131, respectively, and rotate around the rotation axes thereof while holding claws (not illustrated), that are at the distal end portions of arms that extend in directions facing one another at 180° apart with the rotation axis therebetween, grasp the leading end portion of the recording medium P. With the trailing end portion of the recording medium P in a free state, the intermediate conveying sections 126, 128, 130 convey the recording medium P along the respective guiding members (127, 129, 131), such that the reverse surface side of the recording surface is convex.

Note that the intermediate conveying sections 126, 128, 130 may be structured so as to grasp the recording medium P by using chain grippers, and convey the recording medium P with the reverse surface side thereof being convex.

The inkjet recording device 100 of the present exemplary embodiment records an image on the recording surface of the recording medium P. The recording medium P is not particularly limited, and general printing papers, that are used in general offset printing and the like and whose main component is cellulose such as so-called high-grade paper, coated paper, art paper or the like, can be used. At a general printing paper whose main component is cellulose, in image recording by a general inkjet method that uses aqueous ink, relatively, the absorption of ink and drying are slow, it is easy for movement of the color material after droplet ejection to occur, and it is easy for image quality to deteriorate. However, in the inkjet recording device 100 of the present exemplary embodiment, owing to agglomeration, movement of the color material is suppressed, and high-quality image recording of excellent color density and hue is possible.

Among recording media, so-called coating-processed papers that are used in general offset printing and the like are preferable. Coating-processed paper is paper in which a coating layer is provided by coating a coating agent onto the surface of high-grade paper or acid-free paper or the like whose main component is cellulose and that generally has not been surface treated. With coating-processed papers, in image formation by usual aqueous ink jetting, it is easy for problems to arise with respect to quality, such as the gloss or rub-fastness or the like of the image. However, in the inkjet recording device 100 of the present exemplary embodiment, non-uniform gloss is suppressed, and an image having good gloss and rub-fastness can be obtained. In particular, it is preferable to use a coating-processed paper having a base paper and a coating layer that contains an inorganic pigment, and it is more preferable to use a coating-processed paper having a base paper and a coating layer that contains kaolin and/or calcium bicarbonate. Concretely, art paper, coated paper, light-weight coated paper, and finely coating-processed paper are more preferable.

As described above, the processing liquid applying section 114 applies processing liquid onto the recording surface of the recording medium P.

The film thickness of the processing liquid that is coated on the recording surface by the processing liquid coating device 156 is desirably sufficiently smaller than the droplet diameter of the inks that are ejected from the inkjet heads 172M, 172K, 172C, 172Y of the image drawing section 116. For example, when the ejected amount of the ink is 2 pl (picoliters), the average diameter of the droplet is 15.6 μm. At this time, when the film thickness of the processing liquid is thick, the ink dots float within the processing liquid without contacting the surface of the recording medium P. Thus, it is desirable to make the film thickness of the processing liquid be less than or equal to 3 μm in order to obtain a landed dot diameter of greater than or equal to 30 μm when the ejected amount of the ink is 2 pl.

The processing liquid coating device 156 is mainly structured by a processing liquid container, a metering roller, and a coating roller (none of which is illustrated). The processing liquid is stored in the processing liquid container, and a portion of the metering roller is immersed in this processing liquid. A metal roller or an anilox roller, in which numerous cells are formed orderly in a given number of lines in a roller peripheral surface that is formed by coating a ceramic on the surface of a metal roller, is suitably used as the metering roller. Iron or stainless steel or the like is used as the material of the metal roller. When iron is used as the material, in order to improve the hydrophilic nature of the surface and improve the wear-resistance and the rust-proof ability, plating, such as chrome plating or the like, may be carried out on the surface. As the cell structure of the anilox roller, for example, a structure having a number of lines of greater than or equal to 150 lines and less than or equal to 400 lines, a cell depth of greater than or equal to 20 μm and less than or equal to 75 μm, and a cell volume of greater than or equal to 30 $cm^3/m^2$ and less than or equal to 60 $cm^3/m^2$ can suitably be used. The diameter of the metering roller is formed to be, for example, greater than or equal to 20 mm and less than or equal to 100 mm.

The metering roller is supported so as to rotate freely, and is connected to an unillustrated motor, and is driven to rotate at a given speed. Accordingly, the processing liquid within the processing liquid container adheres to the surface of the metering roller, and this processing liquid can be transferred onto the surface of the coating roller. The rotating direction of the metering roller is the same direction as that of the coating roller, and the peripheral speed of the roller outer periphery is the same as that of the coating roller, or a difference in speeds may be provided therebetween. When a difference in speeds is provided, it is suitable for the peripheral speed of the metering roller to be greater than or equal to 80% and less than or equal to 140% of the peripheral speed of coating roller. By adjusting the peripheral speeds of the coating roller and the metering roller, the transfer rate from the metering roller to the coating roller can be adjusted, and the film thickness coated onto the recording medium P can be adjusted.

A doctor blade for metering is provided so as to abut the surface of the metering roller. The doctor blade is disposed at the upstream side, in the rotating direction of the metering roller, with respect to the position of contact between the metering roller and the coating roller, and can meter the coating liquid by scraping-off coating liquid that is on the surface of the metering roller. Due thereto, the coating liquid metered by the doctor blade can be supplied to the coating roller.

A rubber roller having, at the surface thereof, a rubber layer of EPDM or silicon or the like is suitably used as the coating roller. The coating roller is supported so as to rotate freely, and is connected to an unillustrated motor, and is driven to rotate at a given speed. The rotating direction of the coating roller is the same direction as that of the processing liquid drum 154, and the peripheral speed of the roller outer periphery also is the same speed as that of the processing liquid drum 154. Due thereto, the processing liquid, that has been transferred from the metering roller onto the coating roller, is coated on the recording medium P that is held on the processing liquid drum 154.

Because the processing liquid coating device 156 coats the processing liquid by a roller in this way, the processing liquid can be coated onto the recording medium P uniformly and in a small coated amount. Further, it is preferable for the roller of the processing liquid coating means to be made to contact and made to move away at each recording medium, in order for the processing liquid coating device 156 to not dirty the conveying drum for the processing liquid coating (the processing liquid drum 154). The processing liquid drum 154 conveys the recording medium P by the holding claws that hold the leading end of the recording medium P. Due thereto, high-speed conveying of the recording medium P is possible, and the occurrence of sheet conveying jams can be reduced.

Note that IR heaters and warm air blow-out nozzles may be provided at the outer periphery of the processing liquid drum 154 so as to face the peripheral surface thereof, and may dry the processing liquid that is coated on the recording medium P. When IR heaters and warm air blow-out nozzles are provided, the IR heaters are controlled to a high temperature (e.g., 180° C.), and the warm air blow-out nozzles blow-out warm air of a high temperature (e.g., 70° C.) toward the recording medium P at a given air volume (e.g., 9 $m^3$/minute). Due to the heating by these IR heaters and warm air blow-out nozzles, the moisture within the solvent of the processing liquid is evaporated, and a thin film layer of the processing liquid is formed on the recording surface of the recording medium P. By forming the processing liquid into a thin layer in this way, the dots of ink that are ejected at the image drawing section 116 contact the recording surface of the recording medium P, and the necessary dot diameter is obtained, and further, it is easy to obtain the action of the ink reacting with the processing liquid components that have been made into a thin layer, agglomeration of the color material occurring, and the ink being fixed to the recording surface of the recording medium P. Note that the processing liquid drum 154 may be controlled to be a predetermined temperature (e.g., 50° C.).

The processing liquid contains an agglomerating agent that agglomerates components within the ink composition that is applied at the image drawing section 116. The agglomerating agent may be a component that can change the pH of the ink composition, or a polyvalent metal salt, or a polyarylamine. In the present exemplary embodiment, from the standpoint of the ability to agglomerate the ink composition, a compound that can change the pH of the ink composition is preferable, and a compound that can lower the pH of the ink composition is more preferable. Suitable examples of compounds that can lower the pH of the ink composition are highly water-soluble acidic substances (phosphoric acid, oxalic acid, malonic acid, citric acid, or derivatives of these compounds or salts thereof or the like).

In this way, a highly water-soluble acidic substance is preferable as the agglomerating agent, and, from the standpoints of improving the agglomerating ability and fixing the ink overall, organic acids are preferable, and organic acids that are greater than or equal to bivalent are more preferable. Moreover, acidic substances that are greater than or equal to bivalent and less than or equal to trivalent are particularly preferable. As organic acids that are greater than or equal to bivalent, organic acids whose first pKa is less than or equal to 3.5 are preferable, and organic acids whose first pKa is less than or equal to 3.0 are more preferable. Concretely, phosphoric acid, oxalic acid, malonic acid, citric acid, and the like are suitable examples.

In the agglomerating agent, a single type of acidic substance alone may be used, or two or more types may be used in combination. Due thereto, the agglomerating ability improves, and the ink overall can be fixed. The content, within the processing liquid, of the agglomerating agent that agglomerates the ink composition is preferably 1 to 50% by mass, and more preferably 3 to 45% by mass, and even more preferably 5 to 40% by mass. Further, it is preferable that the pH (25° C.) of the ink composition is greater than or equal to 8.0, and that the pH (25° C.) of the processing liquid is within the range of 0.5 to 4. Due thereto, good image density, good resolution, and high-speed inkjet recording can be achieved.

Further, the processing liquid can contain other additives. Examples of other additives are known additives such as drying preventing agents (wetting agents), color fading preventing agents, emulsion stabilizers, penetration accelerating agents, ultraviolet absorbing agents, preservatives, antifungal agents, pH adjusting agents, surface tension adjusting agents, defoaming agents, viscosity adjusting agents, dispersing agents, dispersion stabilizers, rust-proofing agents, chelating agents, and the like.

As described above, in the present exemplary embodiment, a structure that utilizes a coating method by a roller is given as an example, but the applying of the processing liquid is not limited to a coating method, and can be carried out by utilizing a known method such as an inkjet method, an immersion method, or the like. Note that the coating method can be carried out by a known coating method using a bar coater, an extrusion die coater, an air doctor coater, a blade coater, a rod coater, a knife coater, a squeeze coater, a reverse roll coater, or the like.

The processing liquid applying step may be provided either before or after the ink applying step that uses an ink composition. In the present exemplary embodiment, an aspect in which the ink applying step is provided after the processing liquid is applied in the processing liquid applying step is preferable. Concretely, an aspect is preferable in which, before an ink composition is applied on the recording medium P, a processing liquid for agglomerating the pigments within the ink composition and/or particles of a self-dispersing polymer is applied in advance, and the ink composition is applied so as to contact the processing liquid that has been applied on the recording medium P, and an image is formed. Due thereto, the inkjet recording can be made to be high speed, and, even with high speed recording, an image having high density and resolution can be obtained.

The applied amount of the processing liquid is not particularly limited provided that it can cause the ink composition to agglomerate, but preferably can be made to be an amount that is such that the applied amount of the agglomerating agent becomes greater than or equal to 0.1 g/m$^2$. Thereamong, an amount that is such that the applied amount of the agglomerating agent becomes 0.2 to 0.7 g/m$^2$ is preferable. When the applied amount of the agglomerating agent is greater than or equal to 0.1 g/m$^2$, a good, high-speed agglomerating ability is maintained in accordance with various forms of usage of the ink composition. Further, making the applied amount of the agglomerating agent be less than or equal to 0.7 g/m$^2$ is preferable with regard to the point that the surface property of the recording medium to which the agglomerating agent is applied is not adversely affected (the gloss does not change, and the like).

In the processing liquid applying section 114, the processing liquid is, by the processing liquid coating device 156, coated on the recording medium P while being metered, while the recording medium P is conveyed with the leading end portion thereof held by the holding means 155 that is provided at the outer peripheral surface of the processing liquid drum 154.

The recording medium P, to which the processing liquid has been applied at the processing liquid applying section 114, is conveyed by the intermediate conveying section (first transfer cylinder conveying means) 126 to the subsequent image drawing section 116. The recording medium P is conveyed with the leading end portion thereof held by the holding claws (not shown) of the first transfer cylinder conveying means 126, and with the recording surface thereof facing toward the inner side, and with the reverse side thereof forming a convex shape along the guiding member 127.

Further, the first transfer cylinder conveying means 126 has a hot air drying means (not illustrated) at the interior thereof (in a vicinity of the rotational axis), and causes hot air to hit the recording surface (obverse) side of the recording medium P that is facing toward the inner side during the conveying, and dries the processing liquid that has been applied to the obverse. Due thereto, when ink is ejected onto the recording medium P at the image drawing section 116, movement of ink that has landed on the recording medium P at the time of adhering of the ink is prevented.

At the image drawing drum 170 of the image drawing section 116, the leading end portion of the recording medium P, that has been conveyed-in by the first transfer cylinder conveying means 126, is held by the holding means 171 provided at the outer peripheral surface of the image drawing drum 170, and the recording medium P is conveyed while being attracted and fixed to the outer peripheral surface of the image drawing drum 170 by the suction holes provided in the outer peripheral surface of the image drawing drum 170. Further, aqueous inks, that contain thermoplastic resin and color materials, are ejected from the inkjet heads 172M, 172K, 172C, 172Y toward the obverse (recording surface), to which the processing liquid has been applied, of the recording medium P that is fixed on the outer peripheral surface of the image drawing drum 170.

<Image Drawing Section>

In the image drawing section 116 shown in FIG. 2, droplets of corresponding color inks are ejected from the respective inkjet heads 172M, 172K, 172C, 172Y toward the recording surface of the recording medium P that is held tightly on the image drawing drum 170. The inks thereby contact the processing liquid, that was applied in advance to the recording surface at the processing liquid applying section 114, and the color materials (pigments) dispersed in the inks are agglomerated, and color material agglomerates are formed. Due thereto, flowing of color material on the recording medium P, and the like, are prevented, and an image is formed on the recording surface of the recording medium P.

Note that, from the standpoint of obtaining a highly-detailed image, the droplet amount of the ink that is ejected from each of the inkjet heads 172M, 172K, 172C, 172Y is preferably 1 to 10 pl (picoliters), and more preferably 1.5 to 6 pl. Further, from the standpoint of overcoming non-uniformity of the image and improving the connections between the continuous gradations, ejecting the droplets in a combination of different droplet amounts is also effective, and the present invention is suitably applied to such a case as well.

Note that, in the present example, the reference colors (four colors) of CMYK are given as an example, but the combination of the ink colors and the number of colors is not limited to that of the present exemplary embodiment, and light inks, dark inks, and inks of specific colors may be added as needed. For example, a structure to which is added an inkjet head that ejects a light ink such as light cyan, light magenta or the like, also is possible. Further, the order in which the heads of the respective colors are arranged also is not particularly limited.

Image drawing can be carried out in a single pass on the recording medium P by the image drawing section 116 that is structured in this way.

<Drying Section>

The recording medium P, on which an image has been formed at the image drawing section 116, is transferred from the image drawing drum 170 via the intermediate conveying section (second transfer cylinder conveying means) 128 to the drying drum 176 of the drying section 118. The second transfer cylinder conveying means 128 conveys the recording medium P, that has been transferred from the image drawing drum 170, with the leading end portion of the recording medium P being held by holding claws (not shown), and with the recording surface of the recording medium P facing toward the inner side, and with the reverse side thereof forming a convex shape along the guiding member 129.

Note that the second transfer cylinder conveying means 128 may be structured to have an unillustrated hot air drying means (drying means) at the interior thereof, and blow-out hot air toward the recording surface side of the recording medium P that is facing toward the inner side during the conveying, and dry the ink that has been ejected onto the obverse. Due thereto, the ink can be dried immediately after being ejected. Therefore, it becomes easy to reduce cockling of the recording medium P that is due to ink penetration, and it becomes easy to suppress the occurrence of wrinkles due to attraction at the time when the recording medium P is restrained by suction at the drying drum 176 of the drying section 118.

The drying section 118 is a mechanism that dries the moisture that is contained in the solvent dispersed by the color material agglomerating action. The drying drum 176 and the hot air drying means 182, at which plural combinations of an IR heater or the like and a fan are disposed at positions facing the outer peripheral surface of the drying drum 176, are provided at the drying section 118.

The air blowing means 180 (attraction assisting means) is provided at the upstream side (in the rotating direction of the drying drum 176) of the plural hot air drying means 182, so as to face the outer periphery of the drying drum 176.

In the same way as the processing liquid drum 154, the drying drum 176 has the claw-shaped holding means (grippers) 177 at the outer peripheral surface thereof, and can hold the leading end of the recording medium P by the holding means 177. Further, the drying drum 176 has plural suction holes in the outer peripheral surface thereof, and the recording medium P is attracted to the outer peripheral surface of the drying drum 176 by negative pressure, and is conveyed while being restrained at and fit tightly to the outer peripheral surface. Hot air from the hot air blow-out nozzles of the hot air drying means 182 hits the recording medium P, that is restrained at the drying drum 176 in this way, and dries the recording medium P.

The occurrence of cockling is thereby prevented. Further, by making the recording medium P tightly contact the drying drum 176 outer peripheral surface, the occurrence of jamming and paper burning due to the recording medium P contacting the hot air drying means 182 can be prevented.

The hot air blow-out nozzles of the hot air drying means 182 are structured so as to blow-out a given volume of warm air, that is controlled to a predetermined temperature, toward the recording medium P, and the IR heaters are respectively controlled to a predetermined temperature. Due to these hot air blow-out nozzles and IR heaters, the moisture contained in the recording surface of the recording medium P that is held at the drying drum 176 is evaporated, and drying processing is carried out. At this time, the drying drum 176 of the drying section 118 is separated, in terms of structure, with respect to the drying drum 170 of the image drawing section 116, and therefore, at the inkjet heads 172M, 172K, 172C, 172Y, poor ejection of ink caused by drying of the head mechanism portions due to heat drying can be reduced. Further, there are degrees of freedom in setting the temperature of the drying section 118, and the optimal drying temperature can be set.

Note that it is preferable that the evaporated moisture be exhausted together with air to the exterior of the device by an unillustrated exhaust means. Further, the recovered air may be cooled by a cooler (radiator) or the like, and recovered as a liquid.

Further, it is preferable that the outer peripheral surface of the drying drum 176 be controlled to a predetermined temperature. By carrying out heating from the reverse surface of the recording medium P, drying is accelerated, and image destruction at the time of fixing can be prevented.

The range of the surface temperature of the drying drum 176 is preferably greater than or equal to 50° C., and more preferably greater than or equal to 60° C. The upper limit is not particularly limited, but is preferably set to less than or equal to 75° C. from the standpoint of safety (prevention of burns due to high temperatures) in maintenance work such as the cleaning of ink that has adhered to the surface of the drying drum 176 and the like.

It is preferable that the drying drum 176 be heated to a predetermined temperature before the recording medium P is conveyed. By heating the drying drum 176 in advance, drying can be accelerated, and therefore, image destruction is prevented and cockling can be prevented. The heating temperature is preferably made to be the same temperature range as that of the above-described surface temperature of the drying drum 176.

It is preferable that the drying drum 176 be heated to a predetermined temperature in the state in which suction is being carried out, in order to prevent a drop in temperature at the time of suction. Further, if heating is carried out without suction being carried out, in consideration of a drop in temperature at the time when suction is carried out, it is preferable to heat the drying drum 176 to become a temperature higher than the predetermined temperature. Further, by carrying out drying while rotating and conveying the recording medium P with the recording medium P held such that the recording surface thereof faces outward (i.e., in a state in which the recording surface of the recording medium P is curved so as to become the convex side), the occurrence of wrinkles and floating-up of the recording medium P can be prevented, and non-uniform drying due thereto can reliably be prevented.

The air blowing means 180 (attraction assisting means) that is provided at the upstream side of the hot air drying means 182 is for assisting the attraction of the recording medium P to the drying drum 176. The air blowing means 180 blows air in an oblique direction toward the trailing end side of the recording medium P, and control is carried out such that the air hits the recording medium P obliquely toward the transverse direction end portion sides thereof and the force of the air becomes greater at the trailing end. Due thereto, floating-up of the sheet at the trailing end of the recording medium P is prevented, wrinkling of the recording medium P due to attraction is removed, and uniform drying and uniform attraction are made possible. In this way, by using the air blowing means 180 that is an attraction assisting means that does not contact the recording medium P, it is possible to prevent ink, that has not yet dried on the recording medium P, from being transferred to a contacting means and image defects from arising as in the case of assisting attraction by using a contacting means.

The suction force of the drying drum 176 can be expressed as (opening surface area)×(pressure per unit surface area). The suction force can be increased by increasing the surface area occupied by the suction holes at the region where the recording medium is attracted and held, i.e., the opening rate.

It is preferable that the opening rate of the suction holes provided at the outer peripheral surface of the drying drum 176 be greater than or equal to 1% and less than or equal to 75% of the contact surface area between the outer peripheral surface of the drying drum 176 and the recording medium P. If the opening rate is less than 1%, expansion deformation of the recording medium due to moisture absorption after recording cannot be sufficiently suppressed. Further, although drying is promoted by warming the drying drum 176 itself and by the recording medium P contacting the drying drum 176, if the opening rate is greater than 75%, the contact surface area between the reverse surface of the recording medium P and the outer peripheral surface of the drying drum 176 decreases. Therefore, even in the state in which the recording medium P is attracted and held, a sufficient drying performance cannot be achieved, and there is the concern that cockling also will worsen.

Accordingly, by making the opening rate of the suction holes at the outer peripheral surface of the drying drum 176 be greater than or equal to 1% and less than or equal to 75%, suppression/prevention of cockling and improvement of the drying performance can be achieved.

Note that the opening rate is set by the diameter of the suction holes, the hole pitch, and the shape and arrangement of the holes. It is preferable that the hole diameter be set to be greater than or equal to 0.4 mm, and so that traces of indentations (traces of the attraction) due to the negative pressure attraction are not formed in the recording medium P, be set to be less than or equal to 1.5 mm. The hole pitch is preferably greater than or equal to 0.1 mm and less than or equal to 5 mm in order to prevent heat deformation and ensure rigidity of the outer peripheral surface of the drying drum 176. If the intervals between the holes are too large, the effect of suppressing deformation of the recording medium is insufficient, and the occurrence of wrinkles cannot be suppressed that much. Further, when the shapes of the suction holes are angular (acute angular), stress concentrates at the corner portions, and therefore, a shape in which the corner portions are rounded is preferable.

At the rotating conveying body, the amount of deformation of the recording medium P due to the attraction pressure is greater in the axial direction than in the peripheral direction. Accordingly, by forming the suction holes in oval shapes or elongated hole shapes whose long axis directions are the peripheral direction and whose short axis directions are the axial direction, the deformation in the peripheral direction and the deformation in the axial direction of the recording medium P can be made to be uniform.

Due to the recording medium P being dried while being rotated and conveyed while being held at the outer peripheral surface of the drying drum 176 with the recording surface of the recording medium P facing outward (i.e., in a state in which the recording surface of the recording medium P is curved so as to become the convex side), the occurrence of wrinkles and floating-up of the recording medium P can be prevented, and non-uniform drying caused thereby can be reliably prevented.

A flow adjusting plate 181 is formed at the upper side of each of the hot air drying means 182, so as to cover the hot air drying means 182 and such that the hot air blown-out from the hot air drying means 182 is again directed toward the drying drum 176 side. Here, it is good to further provide a guide plate 183 at the drying drum 176 rotating direction downstream side of each of the hot air drying means 182 such that the hot air, that has been blown-out from the respective hot air drying means 182 and has once hit the surface of the drying drum 176, is made to flow so as to again be directed toward the drying drum 176 side. By providing the flow adjusting plates 181 in this way, the heat efficiency is improved, and an improvement in the exhausting ability also can be achieved.

Further, a temperature sensor and a humidity sensor (not shown) are provided within the drying section 118, and the detected temperature and humidity are sent as data to an unillustrated control section. The on/off state or the air volume of the hot air drying means 182 may be controlled on the basis of this temperature and humidity information. Further, the total amount of ink that has been ejected onto the recording medium P, i.e., the ejection density, may be used in controlling the hot air drying means 182. The ejection density is the amount of ink ejected per one recording medium P, and can be computed as data from the contents of the image or the pattern or the like that is recorded.

<Fixing Section>

The recording medium P, on which drying processing has been carried out at the drying section 118, is transferred from the drying drum 176 via the intermediate conveying section (third transfer cylinder conveying means 130) to the fixing drum 184 of the fixing section 120.

When the fixing drum 184 receives the recording medium P from the third transfer cylinder conveying means 130, the leading end portion of the recording medium P is held by the holding means 185 provided at the outer peripheral surface of the fixing drum 184, and the recording medium P is trained around the outer peripheral surface of the fixing drum 184 and conveyed.

The recording medium P, that is conveyed while trained around the outer peripheral surface of the fixing drum 184, is pressurized by the pressing roller (smoothing means) 188, that is disposed so as to face the fixing drum 184, and is pressed against the fixing drum 184 such that curling of the recording medium P is corrected and wrinkles are removed.

The pressing roller 188 is disposed so as to press-contact the fixing drum 184, and structures nip rollers together with the fixing drum 184. Due thereto, the recording medium P is sandwiched between the pressing roller 188 and the fixing drum 184, is nipped at a predetermined nipping pressure (e.g., 0.15 MPa), and smoothing processing is carried out thereon.

The pressing roller 188 may be a heating roller. For example, the pressing roller 188 may be structured as a heating roller in which a halogen lamp is assembled within a pipe made of a metal having good thermoconductivity such as aluminum or the like, and may be controlled to a predetermined temperature (e.g., 60 to 80° C.). Due to the recording medium P being heated and pressed by the pressing roller 188 that is structured as a heating roller, thermal energy of greater than or equal to the Tg temperature (glass transition temperature) of the latex contained in the ink is applied, the latex particles are fused, unevenness of the image surface of the recording medium P is leveled, and glossiness is obtained.

<Matting Agent Coating Section>

Figure 3:
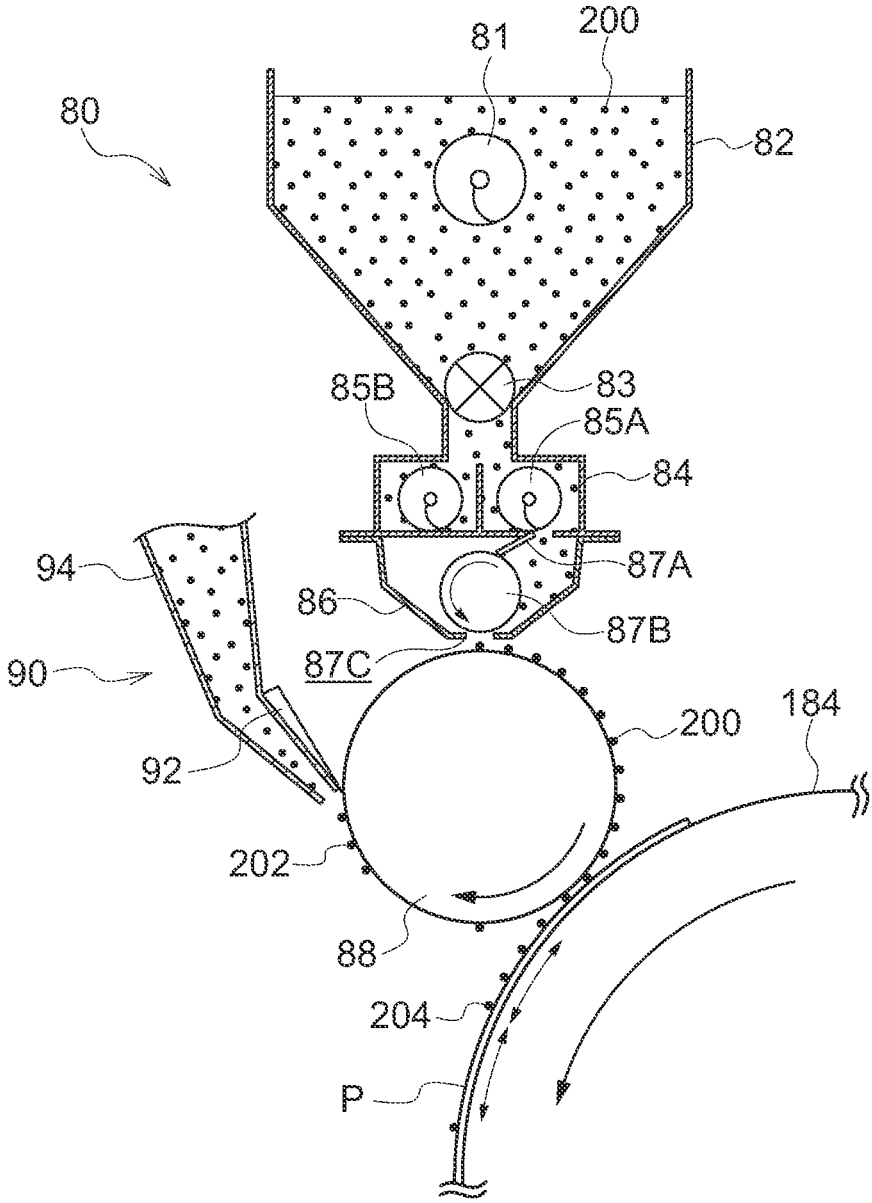
FIG. 3 is an enlarged schematic drawing showing a matting agent supplying section of the image recording device relating to the exemplary embodiment of the present invention.

The matting agent coating section relating to the present exemplary embodiment is shown in FIG. 3. In the matting agent supplying method of the present invention, the matting agent 200, that is stored in the main tank 82 and stirred by a stirring auger 81, is replenished to a supplying section 84 by the opening and closing of a replenishing valve 83, in accordance with the amount of matting agent remaining within the supplying section 84. The matting agent 200 of the supplying section 84 is conveyed, in the depthwise direction perpendicular to the surface of the drawing of FIG. 3, by a supply auger 85A, and is conveyed to the front and back in the depthwise direction within FIG. 3 by a supply auger 85B, and is circulated and supplied.

Various materials such as, for example, acrylic resin powder, starch powder, PVA, and the like can be considered for the matting agent 200. Powders of an average particle diameter of around 5 to 50 μm are suitable, and more desirably, powders of an average particle diameter of around 10 to 30 μm can be suitably used.

The matting agent 200 within the supplying section 84 is supplied to a metering section 86. The supplied amount of the matting agent 200 at the surface of the metering roller 87B is metered by a metering blade 87A, and a predetermined amount of the matting agent 200 is metered and supplied by a slit portion 87C to the application roller 88 that is provided directly beneath.

Here, a closed-cell sponge rubber for example is used as the material of the metering roller 87B. The size of the closed cells is around 5 to 100 times the average particle diameter of the matting agent 200. Namely, through experimentation, the present inventors obtained the knowledge that, by using a closed-cell sponge rubber, the closed cells are deformed and expanded by being pressed by the slit portion 87C, and a predetermined amount of the matting agent 200 that is filled within the closed cells is metered and supplied, and, when the size of the closed cells is less than five times the average particle diameter of the matting agent 200, the closed cells (holes) are relatively too small, and therefore, the matting agent 200 cannot be filled well into the closed cells, whereas when the closed cells are a size exceeding 100 times the average particle diameter of the matting agent 200, the closed cells are relatively too large, and therefore, the holding force by which the particles of the matting agent 200 are held within the closed cells is insufficient, and the matting agent 200 drops-out before reaching the slit 87C.

The effects that the closed cell size of the metering roller surface relating to the exemplary embodiment of the present invention and the average particle diameter of the matting agent have on the stacker blocking performance are shown in Table 1. Namely, as shown in Table 1, the results of functional evaluation are that, when the size of the closed cells is less than five times the average particle diameter of the matting agent 200, regardless of the average particle size of the matting agent 200, the closed cells (holes) are relatively too small, and therefore, the matting agent 200 cannot be filled well into the closed cells. Conversely, when the closed cells are a size exceeding 100 times the average particle diameter of the matting agent 200, the closed cells are relatively too large, and therefore, the holding force for holding the particles of the matting agent 200 within the closed cells is insufficient, and in this case as well, the closed cells cannot be filled well. Therefore, the size of the closed cells must be kept to around 5 to 100 times the average particle diameter of the matting agent 200.

TABLE 1

| matting agent | closed cell size/matting agent particle diameter | | | |
|---|---|---|---|---|
| average particle diameter | up to 5 times | 5 times to 25 times | 25 times to 100 times | more than 100 times |
| 10 μm | — | ○ | ○ | x |
| 30 μm | x | ○ | ○ | x |
| 50 μm | x | ○ | ○ | — |

○: good;
x: poor

Further, the present inventors also found that, when an open-cell sponge rubber is used, the matting agent 200 is gradually filled into the holes that communicate at the interior, and supply of a predetermined amount cannot be achieved stably.

If the size of the closed cells is within the range of 5 to 100 times the average particle diameter of the matting agent 200, the matting agent 200 is supplied to the application roller 88 in a state of being released from the slit 87C. Further, it is desirable that the density of the closed cells be 2 to 3 per square mm when the diameter is 30 μm, and be around 10 per square mm when the diameter is 10 μm.

The matting agent 200 that has been supplied to the surface of the application roller 88 is transferred and applied to the recording medium P that is on the impression cylinder (the fixing drum 184 in FIG. 3). Here, at the image portions of the printed matter (the recording medium P), the matting agent 200 is transferred from the application roller 88 due to the tackiness of the ink film that forms the image, whereas, at the non-image portions, the matting agent 200 is not transferred from the application roller 88 because the tackiness of the surface is smaller than that of the surface of the application roller 88. Due thereto, the matting agent 200 is selectively applied to the image portions of the recording medium P. Further, because the matting agent 200 is pressed by the application roller 88, the matting agent 200 is held in a state of being sunk-into the ink film, and therefore, the matting agent 200 does not come off even at the time of reverse surface printing.

Figure 4:
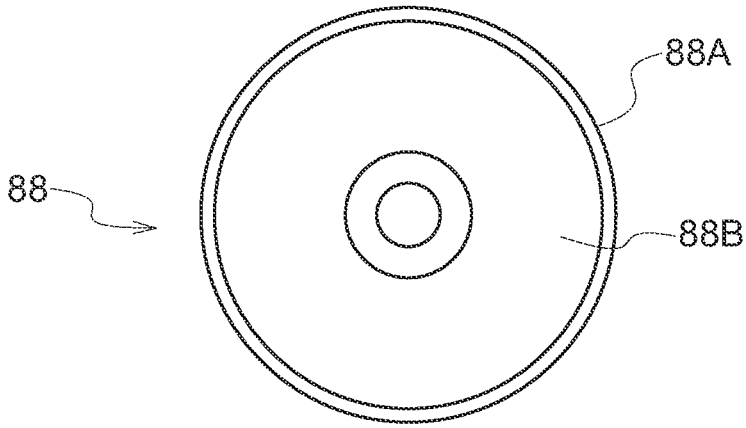
FIG. 4 is a cross-sectional view showing an application roller of the matting agent supplying section shown in FIG. 3.

As shown in FIG. 4, the application roller 88 is structured such that the outer peripheral surface of a rubber roller 88B is covered by a film 88A formed from a fluorine resin such as PFA or the like. The properties such as elasticity and the like are determined by the rubber roller 88B, and the surface properties such as surface roughness and surface energy and the like are determined by the film 88A. Due thereto, the application roller 88 is provided with various parameters that are difficult to realize by a single roller formed of a single material.

Here, a roller around which is wound a fluorine film and that has a surface roughness Ra (arithmetic mean roughness) of preferably less than or equal to 1 μm, and more preferably, a smoothness of less than or equal to 0.5 μm, and small surface energy (surface tension), or the like, is preferable as the application roller 88.

The relationship between the surface properties of the application roller relating to the present exemplary embodiment and the stacker blocking performance is shown in Table 2.

TABLE 2

| | application roller | | | | | | |
|---|---|---|---|---|---|---|---|
| | PFA film-covered elastic roller | sandblasted PFA film-covered elastic roller | | Si rubber roller | | | |
| smoothness (Ra) | 0.5 [μm] | 1.0 [μm] | 1.2 [μm] | 0.5 [μm] | 1.0 [μm] | 1.2 [μm] | 1.0 [μm] |
| surface energy | 50 [mN/m] | 50 [mN/m] | 50 [mN/m] | 80 [mN/m] | 80 [mN/m] | 80 [mN/m] | 90 [mN/m] |
| stacker blocking performance | ○ | | x | | | x | x |

○: excellent;
: good;
x: poor

As shown in Table 2, the surface properties, that are determined by the combination of the surface roughness Ra (μm) and the surface energy (mN/m) of the application roller 88, determine the holdability and releasability of the matting agent 200 that is held on the surface of the application roller 88, and, as a result, determine the stacker blocking performance that is an indicator of blocking (fixing) not being caused when a large number of the recording media P are stacked within the sheet discharging unit 192.

It can thereby be understood that the surface roughness Ra (μm) and surface energy (mN/m) of the application roller 88 are desirably 1.0 (μm) and 80 (mN/m) respectively, and are more preferably 0.5 (μm) and 50 (mN/m) respectively.

Further, matting agent 202, that was not transferred onto the places corresponding to the non-image portions of the printed portion, is recovered by a cleaning section 90, and the recovered matting agent 202 is re-used. At the cleaning section 90, the matting agent 202 is scraped-off from the surface of the application roller 88 by a cleaning blade 92. The scraped-off matting agent 202 is sucked by a suction section 94, and is again recovered in the main tank 82. The blade material of the cleaning blade 92 is not particularly limited provided that it scrapes-off the matting agent 202 without scratching the surface of the application roller 88, and a resin blade, a rubber blade or the like can be suitably used therefor.

CONCLUSION

As described above, in the present exemplary embodiment, the matting agent 200 is metered by a metering roller 87B having, at the surface thereof, closed cells of a closed-cell sponge rubber or the like, and is applied to the surface of the recording medium P by pressing by the application roller 88. Therefore, the following effects are obtained.

Namely, by metering the matting agent 200, that is a powder, by the closed-cell holes that are formed in the surface of the metering roller 87B and supplying the matting agent 200 to the application roller 88, the excess matting agent 200 can be prevented from adhering to the recording medium P and nearby places, and can be prevented from scattering. In particular, when, as a pre-processing, a processing liquid is coated onto the recording medium P as in the present exemplary embodiment, mixing-in of the matting agent 200 into the processing liquid can be effectively prevented.

Further, because the matting agent 200 is a powder, as compared with a method of spraying a dispersion liquid, diffusion within the device is prevented, and further, there is no need for a drying process or the like after coating, and the device structure can be made to be simple and inexpensive. Similarly, as compared with a method of blowing-out a powder, the matting agent 200 is applied by pressing by the application roller 88, and therefore, diffusion of the matting agent 200 within the device can be prevented.

Namely, in an inkjet recording device, due to the need to eject liquid droplets of ink onto the recording medium P, the recording medium P absorbs and is dampened by the liquid (water or the like) that is the solvent/dispersion medium of the ink, and when high-speed processing is needed in particular, there is the concern that the burden on the drying step will become large. In order to prevent stacking that is due to poor drying of the recording media P, and at the same time not impair the dryability of the recording media P, spraying of more liquid is avoided, and by coating the matting agent 200 that is a powder, the stacking performance can be improved without particularly increasing the burden on the drying process.

Moreover, because the holes of the surface of the metering roller 87B are structured to hold the matting agent 200 by closed cells, there is no fear that the metering accuracy will deteriorate during use. If the holes of the surface are open cells for example, because the holes communicate at the interior, the amount of the matting agent 200 that is held in the holes of the surface increases accompanying usage, and there is the concern that accurate metering may gradually become difficult. However, if the holes of the surface are closed cells, the amount of matting agent that is held thereby does not fluctuate, and therefore, accurate metering can be carried out stably.

Further, the matting agent 200, that is applied to the image portions of the recording medium P, is applied by pressing by the application roller 88. Therefore, the matting agent 200 sticks to the image portions, and there is little falling-off of the matting agent 200 in later processes. Dirtying of the device interior or other recording media P due to the matting agent 200 that has fallen-off can be prevented.

<Others>

An exemplary embodiment of the present invention has been described above, but the present invention is not limited in any way to the above-described exemplary embodiment, and can, of course, be embodied in various forms within a scope that does not deviate from the gist of the present invention.

For example, the above-described exemplary embodiment gives an example of a structure in which the matting agent supplying device is set at the downstream side of the fixing section 120. However, there may be a structure in which the matting agent supplying device is set at the downstream side of the drying section 118, provided that the ink film is not transferred even if the ink film contacts the application roller. Further, although the structure of an inkjet recording device that uses aqueous ink that contains thermoplastic resin and color material is given as an example, the present invention is not limited to this. For example, a structure that uses an ultraviolet curing ink, or a structure that uses an inkjet method that ejects usual ink onto regular paper, may be made to be mechanisms to which embodiments of the present invention are applied.

What is claimed is:

1. A matting agent coating device comprising:

a metering section that meters a matting agent that serves as a powder; and an application roller that applies the matting agent, that has been supplied to an outer peripheral surface of the application roller by the metering section, to a recording medium surface by pressing, wherein the metering section comprises a closed-cell rubber roller that holds the matting agent in minute holes of an outer peripheral surface of the closed-cell rubber roller, and a blade that squeezes a surface of the closed-cell rubber roller.

2. The matting agent coating device of claim 1, wherein the outer peripheral surface of the application roller has smoothness Ra of less than or equal to 1 μm and surface energy of less than or equal to 80 mN/m.

3. The matting agent coating device of claim 2, wherein the application roller comprises a rubber roller whose outer peripheral surface is covered by a PFA film.

4. The matting agent coating device of claim 1, wherein a pore size, that is a diameter of the minute holes of the outer peripheral surface of the closed-cell rubber roller, is 5 to 100 times an average particle diameter of the matting agent.

5. The matting agent coating device of claim 1, further comprising a cleaning section having a cleaning blade that abuts the outer peripheral surface of the application roller and scrapes-off, from the outer peripheral surface of the application roller, matting agent that was not applied to the recording medium surface, and a suction section that sucks and removes matting agent scraped-off by the cleaning blade.

6. An inkjet recording device comprising the matting agent coating device of any one of claim 1 through claim 5.

* * * * *